US006470708B1

(12) United States Patent
Green

(10) Patent No.: US 6,470,708 B1
(45) Date of Patent: Oct. 29, 2002

(54) ADJUSTABLE BRACELET AND METHOD OF ADJUSTMENT

(76) Inventor: Sharon Green, 1152 S. Mason, Apt. B-1, Chicago, IL (US) 60644

( * ) Notice: Subject to any disclaimer, the term of this patent is extended or adjusted under 35 U.S.C. 154(b) by 0 days.

(21) Appl. No.: 09/599,691

(22) Filed: Jun. 22, 2000

(51) Int. Cl.[7] ..... A44C 5/00

(52) U.S. Cl. ..... 63/3.2; 63/3.1; 63/3.2; 24/116 A

(58) Field of Search ..... 63/3, 3.1, 3.2; 24/116 R, 116 A

(56) References Cited

U.S. PATENT DOCUMENTS 2,586,758 A * 2/1952 Kerr ..... 63/3.1
3,372,500 A * 3/1968 Claude ..... 63/3.2
D284,176 S * 6/1986 Battersby ..... D11/87
4,611,368 A * 9/1986 Battersby ..... 63/3.2
5,927,577 A * 7/1999 Braun ..... 224/176

* cited by examiner

*Primary Examiner*—Lynne H. Browne
*Assistant Examiner*—Enoch Peavey
(74) *Attorney, Agent, or Firm*—Welsh & Katz, Ltd.

(57) ABSTRACT

An identification bracelet which is adjustable so as to allow the user to continue to use the bracelet even if his wrist size changes is provided. The present invention comprises a chain and a clasp. The clasp, which provides a panel for engraving a name or message, may be opened so that the chain may be adjusted to make the bracelet larger or smaller. The clasp provides a plurality of anchor locations so that numerous different sizes of bracelet may be made. The clasp is generally made in two sections which are rotatably connected so that they may pivot apart, to provide access to the anchor locations, and pivot together to lock the end of the chain within the clasp. The clasp may subsequently be pivoted open again to adjust the size of the chain or for removal of the bracelet.

10 Claims, 2 Drawing Sheets

ADJUSTABLE BRACELET AND METHOD OF ADJUSTMENT

FIELD OF THE INVENTION

The present invention concerns a novel identification-type bracelet which may be adjusted to fit wrists of varying sizes.

BACKGROUND OF THE INVENTION

Identification-type bracelets are a very popular type of jewelry, worn by men, women and children. Typically, an identification bracelet includes an elongated panel, generally made of precious metal, or plated with a precious metal, onto which a name or message may be engraved. Further, identification bracelets, in the form of Medic Alert® bracelets and others, are also used to speak for a wearer when the wearer cannot speak for himself. For example, persons having a disabling condition or medical allergies may wear identification bracelets so that in case of difficulties, in which the person is unable to communicate, medical help may be administered correctly. Also, a young child may be given a bracelet so that the child may be returned home if lost.

Identification bracelets generally also comprise a chain, or other supporting means such as a strap, used to hold the elongated panel on the wearer's wrist. Typically the chain or strap is made of the same material as the elongated panel and is of a fixed length. Such chains generally are broken apart, with one part of the chain attached to each end of the elongated panel. The identification bracelet generally also comprises a clasp, generally having one part of the clasp on each of the free ends of the chain, for fixing the ends of the chain together on the wearer's wrist. Generally, identification bracelets are worn loosely on the wrist, allowing the engraved panel to float to different positions, so as to be comfortable for the wearer and to lessen wear on the engraved panel.

Because of the name or message on the elongated panel, and the ceremony often associated with giving such a bracelet to a child or young adult, identification bracelets often have more meaning, and sentimental value, than other types of jewelry. Often times these types of bracelets are given to a child to celebrate a special occasion or accomplishment, and, unfortunately, the child eventually outgrows the bracelet. Once outgrown, these bracelets become unwearable keepsakes or are misplaced and maybe forgotten. Further, a busy lifestyle may distract the wearer of a medical type bracelet from ordering a replacement when the bracelet becomes tight; leading to non-use of this crucial informative device.

Often times, because of the special significance of the bracelet, the bracelet is worn long after the bracelet no longer comfortably fits the wearer such that it becomes tight on the wrist. The tight fit may cause stress on the chain and clasp elements of the bracelet and may cause extra wear on the elongated panel (which, as noted above, is designed to be worn loosely on the wrist). Such wear may cause deterioration of the panel, including wear on the inscribed portion (both when the inscribed portion is inadvertently inverted and rubs against the wearer's skin and as a result of the panel not being able to float away from outside contact due to the tight fit). Strain on the chain and/or clasp may lead to the breaking of the chain and the subsequent loss of the bracelet.

It would be desirable to have a bracelet that could be worn by a child, or by a person who has a small wrist diameter, and then adjusted, as the diameter of owner's wrist changes, so that the bracelet may, potentially be worn throughout the owner's life.

It is therefore an object of the present invention to provide an identification bracelet that is adjustable such that it maybe worn by the owner as a child and throughout the owner's life.

It is a further object of the present invention to provide a bracelet which may be adjusted so that the bracelet may fit comfortably whether the diameter of ones wrist increases or decreases.

It is a further object of the present invention to provide a bracelet that fits all sizes without needing special fitting by a jeweler or other skilled technician.

Other objects and advantages of the present invention will become apparent as the description proceeds.

SUMMARY OF THE INVENTION

In accordance with the present invention an adjustable bracelet is provided. The bracelet comprises a clasp having a top section and a bottom section, each comprising a first end and a second end. The top section of the bracelet being removably attachable to the bottom section. The bracelet further comprises a chain, having a first and a second end, the first end being attached to the clasp and the second end of the chain comprising an anchor.

The bottom section of the clasp further comprises a plurality of anchor attachments, such that when the top section is removed the anchor may be first releasably attached in the bottom section to a first attachment and may subsequently be releasably attached to another of the attachments, so as to adjust the length of the bracelet. The attachment of the anchor chain within the clasp forms a bracelet when the top and bottom sections are subsequently attached together and the anchor is thereby held onto an anchor point.

In the preferred embodiment of the present invention, the base of the clasp is a rectangular box having a base, at least two parallel walls and an open top. The anchor is a toggle bar and the anchor points are a series of generally parallel pairs of heads soldered onto the bottom section of the clasp. The heads generally extend from the base of the bottom section to generally the height of the parallel walls of the bottom section. The toggle bar may be placed adjacent one pair of heads such that the toggle bar is held against the pair of heads, generally perpendicularly to the walls of the base section, with the chain extending, generally axially with the walls, between the remaining pairs and out of the clasp. The top section of the clasp may then be attached to the bottom section, such that the top section is placed adjacent to the walls and generally the pairs of heads, so as to provide a compartment for the toggle bar and prevent it from rising above the heads. In this manner the toggle bar is held inside the clasp. When a change in size is desired, the top of the clasp may be opened and the toggle bar may be moved adjacent to another pair of heads; the top of the clasp may then be replaced, once again restraining the toggle bar in its new position.

In the preferred embodiment of the present invention, the top and bottom of the clasp are rotatably connected together by a hinge at a first end of the clasp. Generally, the first end of the chain will be attached near the hinge portion of the clasp and the second end of the chain, comprising an anchor, may hang freely. It will be noted that with one end of the two parts of the clasp rotatably connected, the other ends will pivot relative to each other. Locking means, such as friction fit teeth, or a hasp and knob may be provided to releasably attach the second ends of the clasp parts together, holding the anchor in place within the clasp as described above.

In order to provide a more finished appearance to the bracelet of the present invention, the preferred embodiment provides walls along all four sides of the clasp, with the walls, on the top and bottom portions opposed to the hinge having openings to allow the chain to extend neatly therefrom.

A more detailed explanation of the invention is provided in the following description and claims and is illustrated in the accompanying drawings.

DETAILED DESCRIPTION OF THE ILLUSTRATIVE EMBODIMENT

Figure 1:
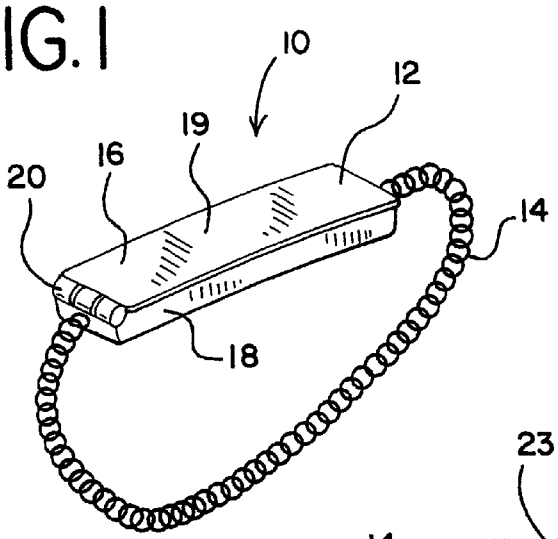
FIG. 1 is a perspective view of an identification bracelet made in accordance with the present invention, in a first closed position.

Referring to the drawings, a bracelet 10 having a clasp 12 and a chain 14 is provided. Clasp 12 comprises a top portion 16 and a bottom portion 18. Top portion 16 generally comprises an engraving panel 19 (FIG. 1), friction fit attachment teeth 20 and top front wall 21. A hinge 23 rotatably connects top portion 16 and bottom portion 18 together, such that top portion 16 maybe pivoted open to reveal the interior 24 of bottom portion 18. It is to be understood that top portion 16 and bottom portion 18 may be constructed such that they may be completely separated from each other and maybe joined together, at both ends, in a friction fit or by other mechanical, magnetic or other means, without departing from the novel scope of the present invention. Bottom portion 18 further comprises side walls 26 and 28, a back wall 30 and a front wall 32. Front wall 32 defines an opening 33 allowing clearance for chain 14 as described below. The combination of top front wall 21 and attachment teeth 20 defines an opening 22 which also allows clearance for chain 14.

A plurality of anchor stops 34 are provided in bottom portion 18. In the preferred embodiment, anchor stops 34 are provided in pairs and are spaced apart to allow the placement of chain 14 between any pair of anchor stops 34. In the illustrative embodiment, anchor stops 34 are as tall as side walls 26 and 28, such that when top 16 is pivoted down onto bottom 18 top 16 is in close proximity to the tops of anchor stops 34. In this manner, as further described below, the closing of clasp 12 locks chain 14 within clasp 12, establishing a specific size for bracelet 10. It is to be understood that anchor stops may be made such that the tops of the anchor stops 34 do not reach the tops of walls 26 and 28, if adjustments are made to the top 16, such as adding counter stops (not shown) to top 16 or making the inner area of top 16 thicker such that top 16 may extend down to the tops of anchor stops 34. Such adjustments, and others, to clasp 12 are contemplated and are within the novel scope of the present invention.

Figure 3:
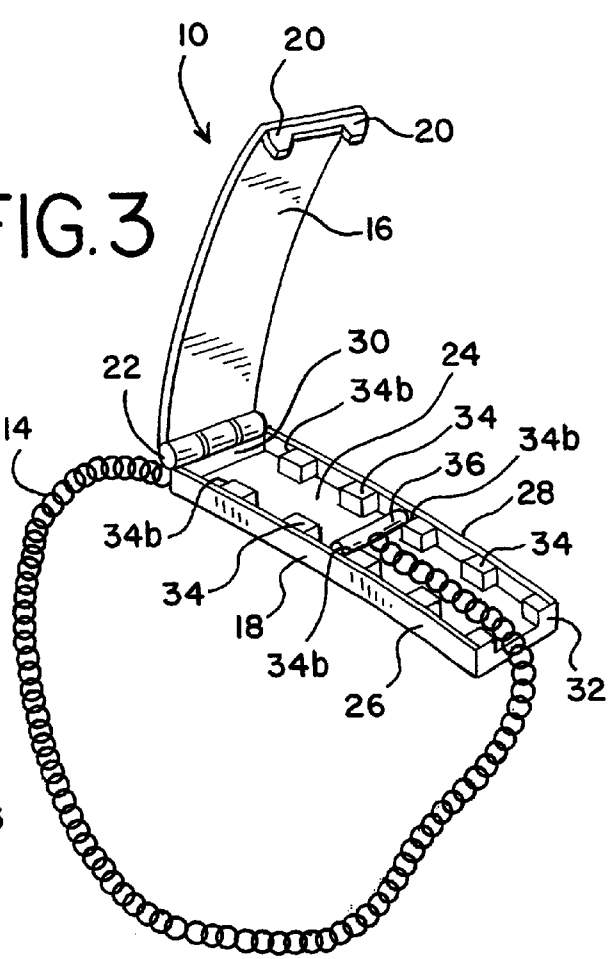
FIG. 3 is another perspective view of the bracelet of FIG. 2.
Figure 4:
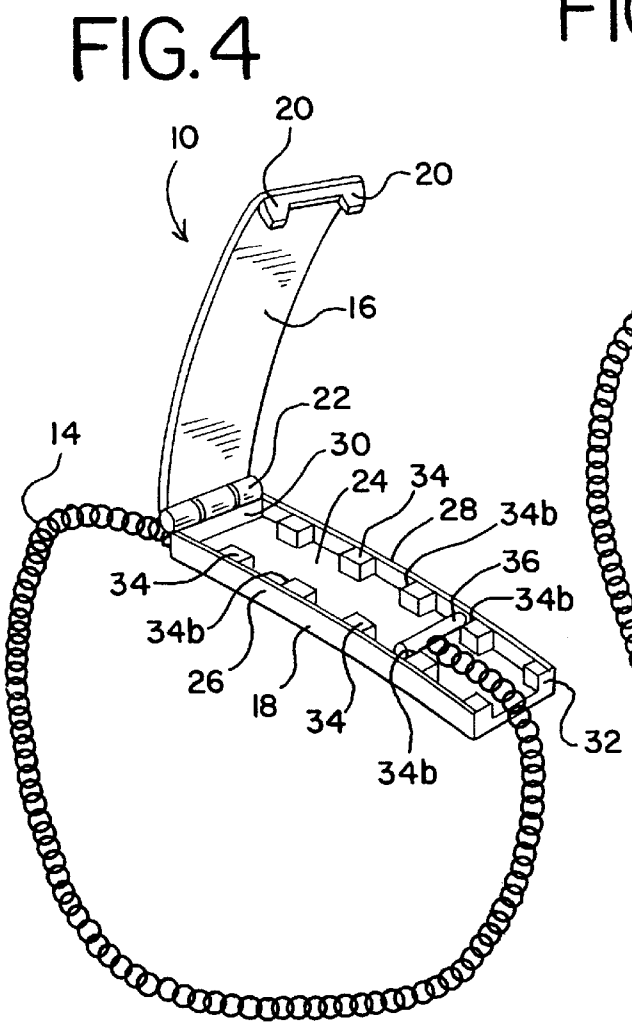
FIG. 4 is another perspective view of the bracelet of FIG. 2.

In the illustrative embodiment, chain 14 is attached, by any conventional means including soldering or welding, to the outside of back wall 30, at one end, and to a toggle 36 at the other end. Toggle 36 is generally a cylindrical pin having a length along its main cylindrical axis such that toggle 36 spans the distance between a pair of anchor stops 34 such that toggle 36 may not be pulled from anchor stops 34 once toggle 36 is placed within clasp 12. As may be seen in FIGS. 3 and 4, a user of the present invention may move toggle 36, inside of clasp 12 to any desired set of anchor points, so as to adjust the length of bracelet 10.

In the use of bracelet 10, a user may pull the top front wall 21 of bracelet 10 such that attachment teeth 20, on top portion 16, are released from their friction fit against front wall 32 of bottom portion 18. It is to be understood that while a friction fit is shown and described, the attachment of top portion 16 to bottom portion 18 may be made in any number of well known ways, including the use of mechanical locking means or magnets, without departing from the novel scope of the present invention. Once released from bottom portion 18, top portion 16 may be pivoted, about hinge 23, such that top portion 16 is separated from bottom 18, allowing access to the interior of clasp 12.

The interior of clasp 12 comprises a series of anchor points 34 which may engage toggle 36 such that chain 14 is held in clasp 12. The series of anchor points allows bracelet 10 to be adjusted in size to fit a wide variety of wrist sizes. Upon the selection of the appropriate anchor points 34, and the placement of toggle 36 adjacent the back side 34*b* of the anchor points, top portion 16 may be pivoted downward so as to engage bottom portion 18 locking the portions of clasp 12 together. Chain 14 may then extend through openings 22 and 33 defined on the respective front walls 21 and 32, of top portion 16 and bottom portion 18.

Removal and placement of bracelet 10 about the wrist may be accomplished in this manner, utilizing the identification portion 12 of the bracelet as a clasp. Further, a change in wrist size may be compensated for by placing toggle 36 adjacent a different set of anchor points 34.

It is to be understood that top portion 16 and bottom portion 18 of clasp 12 may be joined, at both ends, by a variety of different means, all well known in the art (including, locks, magnets and combinations of these and hinges) without departing from the novel scope of the present invention.

Figure 2:
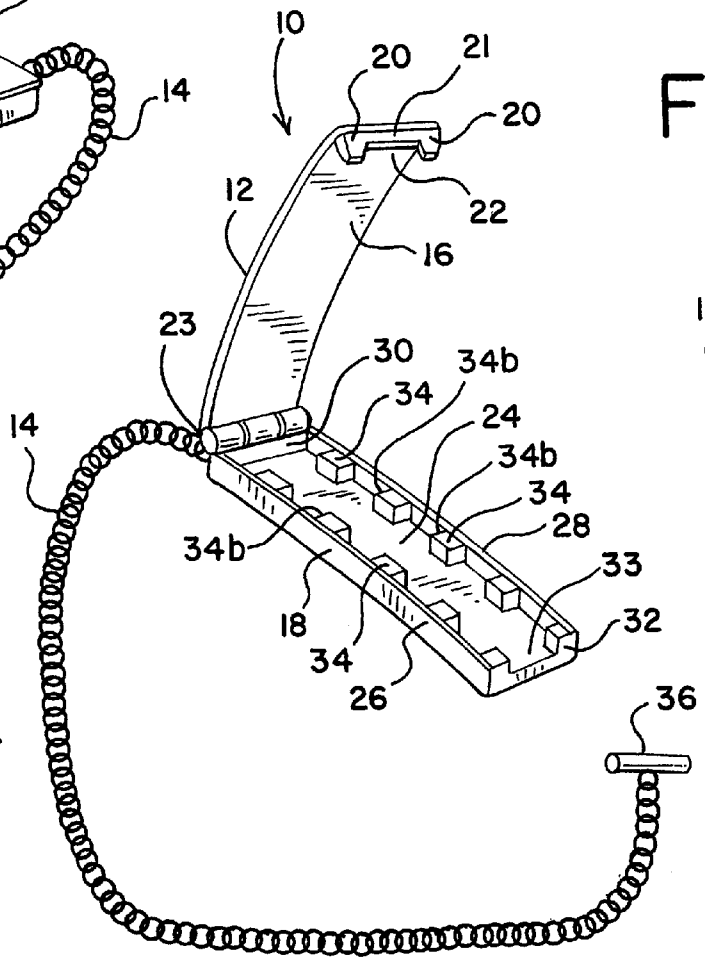
FIG. 2 is a perspective view of the bracelet of FIG. 1 in a second, open position.
Figure 6:
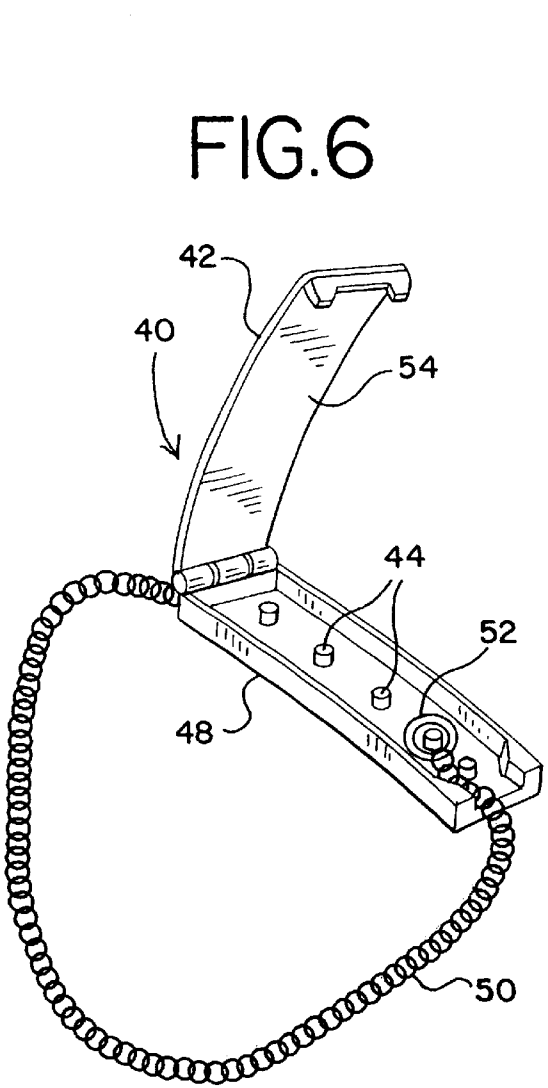
FIG. 6 is another perspective view of the bracelet of FIG. 5.
Figure 5:
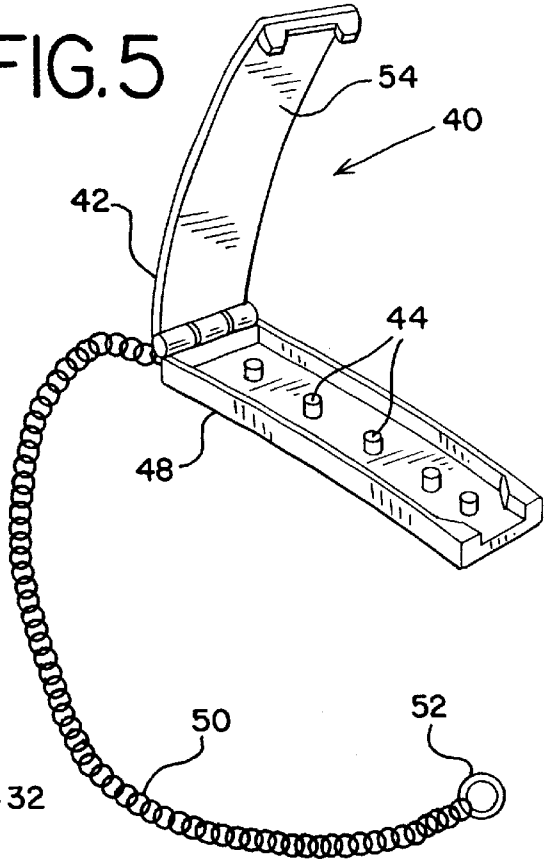
FIG. 5 is a perspective view of another embodiment of the bracelet of FIG. 1.

Further, as shown in FIGS. 5 and 6, other types of anchor stops 44 and anchors 52 may be used to produce an adjustable bracelet of the present invention. In FIGS. 5 and 6, a bracelet 40, having a clasp 42, is provided with a plurality of anchor stops 44, generally shown as pegs 44, within a clasp bottom portion 48. A chain 50 having a loop 52 is provided and is attached to bottom portion 48 in a manner previously described. Loop 52 may be placed on an appropriate peg 44 to provide a comfortable length for bracelet 40 and a top portion 54 may then be closed down upon bottom portion 48, as previously described. As noted previously concerning anchor stops 34 of FIGS. 2, 3 and 4, it is contemplated that the tops of pegs 44 will be proximate to the top portion 54 of clasp 42, such that loop 52 may not free itself from within clasp 42.

Although illustrative embodiments of the invention have been shown and described, it is to be understood that various modifications and substitutions may be made by those skilled in the art without departing from the novel spirit and scope of the invention.

What is claimed is:

1. An adjustable bracelet comprising:

a clasp, having a top section and a bottom section, said top and bottom sections each comprising a first end and a second end, said top section being removably attachable to said bottom section;

a chain, having a first end and a second end, said first end of said chain being attached to said clasp, said second end of said chain comprising an anchor, said anchor comprising a ring;

said bottom section of said clasp comprising a plurality of anchor attachments, said plurality of anchor attachments comprising spaced apart pegs, such that said bracelet is adjustable by first releasably attaching said ring to one of said pegs in said bottom section when said top section is removed, and subsequently attaching said ring to another of said pegs to adjust the length of said bracelet, such that said clasp and chain form a bracelet when said top and bottom sections are subsequently attached together.

2. The adjustable bracelet of claim 1, wherein said top and bottom sections are rotatably attached at said first ends such that said top and bottom sections may be pivoted apart at said second ends.

3. The adjustable bracelet of claim 2, wherein said top and bottom sections are rotatably attached by a hinge.

4. The adjustable bracelet of claim 1, wherein said anchor attachments are a plurality of generally parallel placed, spaced apart, pairs of heads extending inwardly from both sides of the bottom section and the anchor is a horizontal bar.

5. The adjustable bracelet of claim 4, wherein said anchor is a toggle of a sufficient length to exceed the space between said heads.

6. An adjustable bracelet comprising:

a clasp, having a top section and a bottom section, said top and bottom sections each comprising a first end and a second end, said top section being removably attachable to said bottom section;

a chain, having a first end and a second end, said first end of said chain being attached to said clasp, said second end of said chain comprising an anchor;

said bottom section of said clasp having a plurality of spaced apart anchor attachments extending upward from the inside bottom wall of said bottom section and inwardly towards the center of said bottom section such that said anchor can be first releasably attached in said bottom section to a first anchor attachment, when said top section is removed, and can subsequently be removably attached to another of said anchor attachments, so as to adjust the length of said bracelet, such that said clasp and chain form a bracelet when said top and bottom sections are subsequently attached together.

7. The adjustable bracelet of claim 6, wherein said top and bottom sections are rotatably attached at said first ends such that said top and bottom sections can be pivoted apart at said second ends.

8. The adjustable bracelet of claim 7, wherein said top and bottom sections are rotatably attached by a hinge.

9. The adjustable bracelet of claim 6, wherein said anchor attachments are a plurality of generally parallel placed, spaced apart, pairs of heads.

10. The adjustable bracelet of claim 9, wherein said anchor is a toggle of a sufficient length to exceed the space between said heads.

* * * * *